United States Patent [19]

Hiraishi et al.

[11] 4,441,926

[45] Apr. 10, 1984

[54] NON-MAGNETIC ALLOY HAVING HIGH HARDNESS

[75] Inventors: Hisashi Hiraishi, Kyoto; Yoshiaki Yamakami, Toyonaka; Atsunobu Shintani, Hirakata, all of Japan

[73] Assignee: Kubota Ltd., Osaka, Japan

[21] Appl. No.: 416,235

[22] Filed: Sep. 9, 1982

[30] Foreign Application Priority Data

Oct. 14, 1981 [JP] Japan ..... 56-163721

[51] Int. Cl.[3] ..... C22C 38/58

[52] U.S. Cl. ..... 75/128 A; 75/128 V; 148/38; 164/504; 164/448

[58] Field of Search ..... 75/128 A, 128 V, 128 R, 75/128 W, 128 G; 148/38, 137; 161/504, 442, 448, 468

[56] References Cited

U.S. PATENT DOCUMENTS 3,151,979 10/1964 Carney et al. ..... 75/128 V 3,574,605 6/1968 Hall et al. ..... 75/128 V 3,711,276 1/1973 Hellner et al. ..... 75/128 A

OTHER PUBLICATIONS

The Journal of the Iron and Steel Institute of Japan; vol. 67, Sep. 1981, p. 192, by Sakamoto et al.

*Primary Examiner*—L. Dewayne Rutledge
*Assistant Examiner*—Debbie Yee
*Attorney, Agent, or Firm*—Armstrong, Nikaido, Marmelstein & Kubovcik

[57] ABSTRACT

An alloy comprising, by weight, 0.1–0.6% C, up to 2% Si, 5–15% Mn, 5–15% Cr, 5–13% Ni, 1–3% V, and at least one of up to 1% Mo and up to 2% Nb, the balance being substantially Fe and inevitable impurities. The alloy has an outstanding non-magnetic property of up to about 1.004 in magnetic permeability and high hardness of above about 215 in Vickers hardness and is useful for electromagnetic stirrer rolls for continuous casting equipment.

2 Claims, No Drawings

NON-MAGNETIC ALLOY HAVING HIGH HARDNESS

BACKGROUND OF THE INVENTION

The present invention relates to an improvement in non-magnetic austenitic stainless steel.

Pinch rolls are used in continuous casting equipment for continuously withdrawing a slab or the like from a mold containing molten steel. When the slab passes between the pinch rolls, the inner portion of the slab is still in a molten state and is prone to segregation in the course of solidification. Accordingly an electromagnetic stirrer is provided for at least one of pinch rolls to produce a moving magnetic field and pass the slab through the magnetic field, thereby causing lines of magnetic force to stir the unsolidified inner portion of the slab to improve the quality of the portion.

The pinch roll having the electromagnetic stirrer therein must of course be non-magnetic so as not to be magnetized itself and must also have high hardness so as to have good durability.

The materials heretofore used for such rolls include 0.03C-18CR-8-Ni alloy (AISI 304). However, the alloy is about 1.006 in magnetic permeability $\mu$ and about 165 in Vickers hardness and is not fully satisfactory in magnetic permeability and hardness, so that it is required to develop non-magnetic alloys having a lower magnetic permeability and higher hardness.

SUMMARY OF THE INVENTION

The present invention fulfills the above requirement.

An object of the invention is to provide an alloy comprising 0.1–0.6% (by weight, the same as hereinafter) C, up to 2% Si, 5–15% Mn, 5–15% Cr, 5–13% Ni, 1–3% V, and at least one of up to 1% Mo and up to 2% Nb, the balance being substantially Fe and inevitable impurities.

Another object of the invention is to provide an alloy having an outstanding non-magnetic property of up to about 1.004 in terms of magnetic permeability and high hardness of above about 215 in terms of Vickers hardness.

The reasons for limiting the components of the present alloy as above will be described below.

C: 0.1–0.6%.

C is a useful element for forming austenite to render the alloy non-magnetic and is also necessary to give increased hardness. The C content, if less than 1%, is not fully effective in affording hardness. Although this effect can be enhanced by increasing the content, an excess of C results in reduced toughness and adversely leads to increased permeability through the coarse-grained carbides, so that the C content should be up to 0.6%. Si: up to 2%

Si, which must be used as a deoxidizer, acts as a ferrite forming element and increases the magnetic permeability when present in a large amount. To avoid the objectionable effect, the Si content should not exceed 2%.

Mn: 5–15%

Mn is essential to the alloy as a deoxidizing and desulfurizing element and also as an austenite forming element. It is desired that at least 5% of Mn be present for stabilizing the austenitic phase. However, when containing Mn in an excessively large amount, the alloy becomes to less resistant to oxidation at high temperatures in addition to its reduced hardness, so that the upper limit of the Mn content is 15%.

Cr: 5–15%

Cr is effective for giving improved resistance to oxidation and higher hardness. To be fully effective, Cr is preferably present in an amount of at least 5%. At a high content, however, Cr which forms ferrite renders the austenitic phase instable. It is therefore desired that the Cr content be up to 15%. P Ni: 5–13%

Ni is a very useful element for forming austenite. At least 5% of Ni must be present for the formation and stabilization of austenite. However, the increase of the Ni content leads to reduced hardness, so that the upper limit for the Ni content is 13%.

V: 1–3%

V is effective for producing finer grains, thereby contributing to the improvement of toughness. And also, V contributes to the increase of hardness through the precipitation of carbides. The element fails to produce a sufficient effect if present in an amount of less than 1%, whereas the effect almost levels off and adversely increases the magnetic permeability when the V content exceeds 3%. The upper limit is therefore 3%.

Mo: up to 1%; Nb: up to 2%

Both Mo and Nb produce improved hardness through the hardening of austenite solid solution and the precipitation and hardening of carbides. However, these elements, which form ferrite, impair the stability of the austenitic phase if used in large amounts. To avoid this objection, it is preferred that the Mo content be up to 1%, and the Nb content up to 2%. Although one of these elements is usable singly, both elements, if used conjointly, will produce a synergistic effect to give greatly increased hardness.

While it is desirable that the alloy contain P, S and other impurities in minimized amounts, no particular objection will result if these impurities are such that they become inevitably incorporated into the alloy in an industrial alloy manufacturing process.

The alloy of this invention is subjected to solution heat treatment in the usual manner, and the supersaturated austenite is allowed to stand at room temperature. The resulting alloy has outstanding nonmagnetic property, i.e. low magnetic permeability, and high hardness.

The present invention will be described below in greater detail with reference to the following example.

EXAMPLE

Alloy specimens of various compositions were prepared, then subjected to solution treatment (1100° C.×3 hr., cooling with water) and thereafter checked for magnetic permeability and hardness. The magnetic permeability was measured by Phörster Probe magnetic permeability tester. The hardness was measured by Vickers hardness tester under a load of 10 Kg.

Table 1 shows the chemical compositions of the specimens and the magnetic permeability and hardness values thereof measured. Specimens Nos. 1 to 12 are alloys of the invention, and specimens Nos. 101 to 113 are the alloys compared with those of the invention in respect of the magnetic permeability and hardness. The underlined contents of components of specimens Nos. 101 to 112 are outside the ranges defined by the invention. Specimens No. 113 is 0.03C-18-Cr-8Ni alloy (AISI 304) conventionally used for electro-magnetic stirrer rolls.

TABLE 1

| No. | Chemical composition (wt. %) C | Si | Mn | Cr | Ni | V | Mo | Nb | Magnetic permeability | Vickers hardness |
|---|---|---|---|---|---|---|---|---|---|---|
| | | | | Alloys of the invention | | | | | | |
| 1 | 0.13 | 0.7 | 8.5 | 7.5 | 7.0 | 1.3 | 0.6 | — | 1.004 | 218 |
| 2 | 0.30 | 0.8 | 9.0 | 8.0 | 7.5 | 1.5 | 0.5 | — | 1.004 | 219 |
| 3 | 0.58 | 0.9 | 8.7 | 8.1 | 7.3 | 1.2 | 0.4 | — | 1.002 | 220 |
| 4 | 0.50 | 0.8 | 5.1 | 8.0 | 7.0 | 1.3 | 0.5 | — | 1.004 | 221 |
| 5 | 0.51 | 0.8 | 15.0 | 8.3 | 7.5 | 1.4 | 0.6 | — | 1.000 | 226 |
| 6 | 0.50 | 0.7 | 8.5 | 5.1 | 7.5 | 1.3 | 0.5 | — | 1.003 | 220 |
| 7 | 0.50 | 0.8 | 9.1 | 14.8 | 7.5 | 1.3 | 0.5 | — | 1.004 | 238 |
| 8 | 0.51 | 0.7 | 8.5 | 8.0 | 5.1 | 1.4 | 0.5 | — | 1.004 | 240 |
| 9 | 0.49 | 0.7 | 8.7 | 8.0 | 12.7 | 1.4 | 0.5 | — | 1.002 | 218 |
| 10 | 0.48 | 0.8 | 8.7 | 8.4 | 7.4 | 2.8 | 0.6 | — | 1.003 | 222 |
| 11 | 0.50 | 0.7 | 8.1 | 8.0 | 7.5 | 1.1 | — | 1.5 | 1.001 | 215 |
| 12 | 0.48 | 0.8 | 8.6 | 8.3 | 7.8 | 1.4 | 0.6 | 1.5 | 1.003 | 239 |
| | | | | Alloys for comparsion | | | | | | |
| 101 | 0.05 | 0.9 | 9.0 | 8.1 | 7.1 | 1.3 | 0.5 | — | 1.006 | 175 |
| 102 | 0.80 | 1.0 | 8.6 | 7.9 | 7.5 | 1.4 | 0.6 | — | 1.007 | 280 |
| 103 | 0.51 | 0.8 | 3.4 | 7.9 | 8.0 | 1.5 | 0.5 | — | 1.006 | 218 |
| 104 | 0.50 | 0.8 | 16.7 | 7.8 | 8.1 | 1.6 | 0.4 | — | 1.005 | 196 |
| 105 | 0.50 | 0.7 | 8.7 | 3.1 | 7.6 | 1.5 | 0.4 | — | 1.001 | 209 |
| 106 | 0.49 | 0.6 | 8.4 | 17.0 | 7.5 | 1.4 | 0.6 | — | 1.008 | 248 |
| 107 | 0.48 | 0.7 | 8.9 | 8.1 | 3.0 | 1.5 | 0.5 | — | 1.007 | 245 |
| 108 | 0.50 | 0.6 | 8.4 | 8.0 | 15.0 | 1.4 | 0.7 | — | 1.001 | 209 |
| 109 | 0.51 | 0.8 | 8.9 | 7.9 | 7.6 | 0.3 | 0.5 | — | 1.001 | 210 |
| 110 | 0.47 | 0.7 | 9.0 | 8.4 | 7.3 | 4.1 | 0.4 | — | 1.010 | 230 |
| 111 | 0.41 | 0.8 | 8.6 | 8.5 | 7.9 | 1.4 | 1.8 | — | 1.006 | 237 |
| 112 | 0.52 | 0.9 | 8.4 | 8.0 | 7.5 | 1.5 | 0.5 | 2.9 | 1.007 | 245 |
| 113 | 0.03 | 0.7 | 0.8 | 18.1 | 9.0 | — | 0.3 | — | 1.006 | 165 |

The mark "—" indicates absence of the element.

The above test results show that the alloy speciments Nos. 1 to 12 of the invention are up to 1.004 in magnetic permeability and have high hardness of at least 215 in Vickers hardness. Thus they are superior to the conventional specimen No. 113 in non-magnetic property and hardness. The other comparison specimens (Nos. 101 to 112) with the contents of some components outside the ranges defined by the invention have relatively high hardness except for specimen Nos. 101 and 104 but vary greatly in magnetic permeability, some being low in hardness although low in magnetic permeability. Thus they are inferior to the alloys of the invention in that they are not satisfactory in both characteristics.

Briefly the alloy of this invention has low magnetic permeability and high hardness and is therefore suited as the material for electromagnetic stirrer rolls for use in continuous casting equipment. Because such stirrer rolls prepared from the alloy of the invention effectively agitate the inner unsolidified portion only of the slab passing thereover without being magnetized themselves owing to the outstanding non-magnetic characteristics, the rolls achieve an improved energy efficiency while having enhanced durability afforded by the high hardness.

The alloy of the invention is not only useful for electromagnetic stirrer rolls of continuous casting apparatus but is of course usable for various other apparatus, such as nuclear fusion apparatus, linear motor cars, etc., as components thereof which must have low magnetic permeability and high hardness.

The present invention is not limited to the foregoing description but can be readily modified variously by one skilled in the art without departing from the spirit of the invention. Such modifications are included within the scope of the invention.

What is claimed is:

1. An electromagnetic stirrer roll adapted for use in continuous casting consisting essentially of a non-magnetic alloy having a magnetic permeability up to 1.004 and a Vickers hardness of at least 215, said alloy consisting essentially of the following components in the following proportions in % by weight:

| | |
|---|---|
| C | 0.1–0.6, |
| $0 < Si \leqq 2.0$, | |
| Mn | 5–15, |
| Cr | 7.5–15, |
| Ni | 5–13, |
| V | 1.1–3, and |
| One of | $0 < Mo \leqq 1$ and |
| | $0 < Nb \leqq 2$, |

the balance being substantially Fe and inevitable impurities.

2. An electromagnetic stirrer roll adapted for use in continuous casting consisting essentially of a non-magnetic alloy having a magnetic permeability up to 1.004 and a Vickers hardness of at least 215, said alloy consisting essentially of the following components in the following proportions in % by weight:

| | |
|---|---|
| C | 0.1–0.6, |
| $0 < Si \leqq 2.0$, | |
| Mn | 5–15, |
| Cr | 7.5–15, |
| Ni | 5–13, |
| V | 1.1–3, |
| $0 < Mo \leqq 1$, and | |
| $0 < Nb \leqq 2$, | |

the balance being substantially Fe and inevitable impurities.

* * * * *